US006605012B2

(12) United States Patent
Muller

(10) Patent No.: US 6,605,012 B2
(45) Date of Patent: Aug. 12, 2003

(54) MODULAR BROADHEAD

(76) Inventor: Philip Muller, 6 Terrapin La., Mercerville, NJ (US) 08619

( * ) Notice: Subject to any disclaimer, the term of this patent is extended or adjusted under 35 U.S.C. 154(b) by 0 days.

(21) Appl. No.: 10/094,125

(22) Filed: Mar. 8, 2002

(65) Prior Publication Data

US 2002/0128096 A1 Sep. 12, 2002

Related U.S. Application Data

(60) Provisional application No. 60/286,030, filed on Apr. 24, 2001, and provisional application No. 60/273,819, filed on Mar. 8, 2001.

(51) Int. Cl.[7] ..... F42B 6/08
(52) U.S. Cl. ..... 473/584
(58) Field of Search ..... 473/578, 583, 473/584

(56) References Cited

U.S. PATENT DOCUMENTS 4,974,859 A * 12/1990 Briesemeister
5,018,747 A * 5/1991 Brown
6,045,468 A * 4/2000 Tinsley et al. ..... 473/584
6,077,180 A * 6/2000 Adams ..... 473/584
6,283,880 B1 * 9/2001 Barrie ..... 473/584

* cited by examiner

*Primary Examiner*—John A. Ricci
(74) *Attorney, Agent, or Firm*—James M. Singer; Pepper Hamilton LLP

(57) ABSTRACT

A modular broadhead having a blade carrying body, a unitary blade unit with multiple blades each with razor edges extending radially from the front of the unitary blade unit rearwardly to a base, and a locking collar for securing the unitary blade unit to the blade carrying body. The base of each blade extends inwardly toward the central axis of the unitary blade unit and forms a tab capable of being slidably received in a rear slot on the blade carrying body. The blade carrying body has multiple rear slots to receive each tab. The blade carrying body has multiple front slots for slidably receiving each of the blades toward the front of the unitary blade unit. The blade carrying body has outer threads forward of the rear slots. The locking collar has inner threads capable of mating with the outer threads on the blade carrying body.

5 Claims, 5 Drawing Sheets

MODULAR BROADHEAD

CLAIM OF PRIORITY

This application claims priority to the United States Provisional Patent Application entitled "Metal Injection Molding Of Unitary, Three Bladed Chisel-Type Broadheads," filed Apr. 24, 2001, having a Ser. No. of 60/286,030. This application also claims priority to the United States Provisional Application entitled "Broadhead with Locking Ring," filed Mar. 8, 2001, having a Ser. No. of 60/273,819.

BACKGROUND OF THE INVENTION

1. Field of the Invention

This invention relates to broadhead hunting arrows and more particularly to a modular broadhead having a unitary blade unit, a blade carrying body and a locking collar for securing the unitary blade unit to the blade carrying body. The blade carrying body may be either a ferrule or an arrow shaft.

2. Discussion of the Related Art

There are many broadheads disclosed in the prior art. These are often made of multiple pieces fitting together to form the broadhead unit which is then attached to the shaft of an arrow. The resulting broadhead can be disassembled into the component parts, including usually the individual blades, a tip, a ferrule of some sort and other connecting parts. Examples of these multi-piece broadheads are found in U.S. Pat. No. 2,940,758 issued to Richter; U.S. Pat. No. 4,928,969 issued to Nagatori; U.S. Pat. No. 4,643,435 issued to Musacchia; U.S. Pat. No. 4,210,330 issued to Kosbab; U.S. Pat. No. 4,175,749 issued to Simo; U.S. Pat. No. 6,045,468 issued to Tinsley, et al.; U.S. Pat. No. 4,944,520 issued to Fingerson, et al.; U.S. Pat. No. 4,570,941 issued to Saunders; U.S. Pat. No. 5,494,297 issued to Maleski; U.S. Pat. No. 4,036,499 issued to Sherwin; U.S. Pat. No. 5,496,043 issued to Ester; and U.S. Pat. No. 5,931,751 issued to Cooper.

For example, U.S. Pat. No. 2,940,758, issued to Richter, discloses a broadhead having a central body with grooves to removably receive multiple blades. In use, a pointed tip screws onto the central body and captures the front tip of each of the blades to hold them in place. A ferrule screws onto the rear of the central body and captures the rear tip of each of the blades to hold them in place. This broadhead blade unit can be disassembled into its component parts.

Another example is U.S. Pat. No. 4,928,969 issued to Nagatori, which discloses a broadhead with a replaceable secondary arrow blade received within a slot of the primary arrow blade which is all received within a slotted ferrule. This broadhead can similarly be disassembled into its component parts.

The prior art broadheads are relatively complex, usually with many pieces including quite often individual blades that must be joined together like a jigsaw puzzle.

BRIEF SUMMARY OF THE INVENTION

This invention is a modular broadhead comprising a blade carrying body, a unitary blade unit with multiple blades each with razor edges extending radially from the front of the unitary blade unit rearwardly to a base, and a locking collar for securing the unitary blade unit to the blade carrying body, the base of each blade extending inwardly toward the central axis of the unitary blade unit and forming a tab capable of being slidably received in a rear slot on the blade carrying body, the blade carrying body having multiple rear slots to receive each tab, the blade carrying body having multiple front slots for slidably receiving each of the blades toward the front of the unitary blade unit, the blade carrying body having outer threads forward of the rear slots, and the locking collar having inner threads capable of mating with the outer threads on the blade carrying body. Preferably, each tab has a nipple at the end extending toward the front of the unitary blade unit, wherein the locking collar has an annular ring capable of receiving each nipple on each tab. Preferably, each of said multiple rear slots has a rear shoulder stop to prevent the unitary blade unit from sliding rearwardly of the stop.

When the unitary blade unit has at least three blades, the blade carrying body may optionally be modified so as not to have the front slots therein. The front of the blade carrying body is capable of being received within an indent created by the blades at the central axis toward the front of the unitary blade unit.

DETAILED DESCRIPTION OF THE INVENTION

Figure 1:
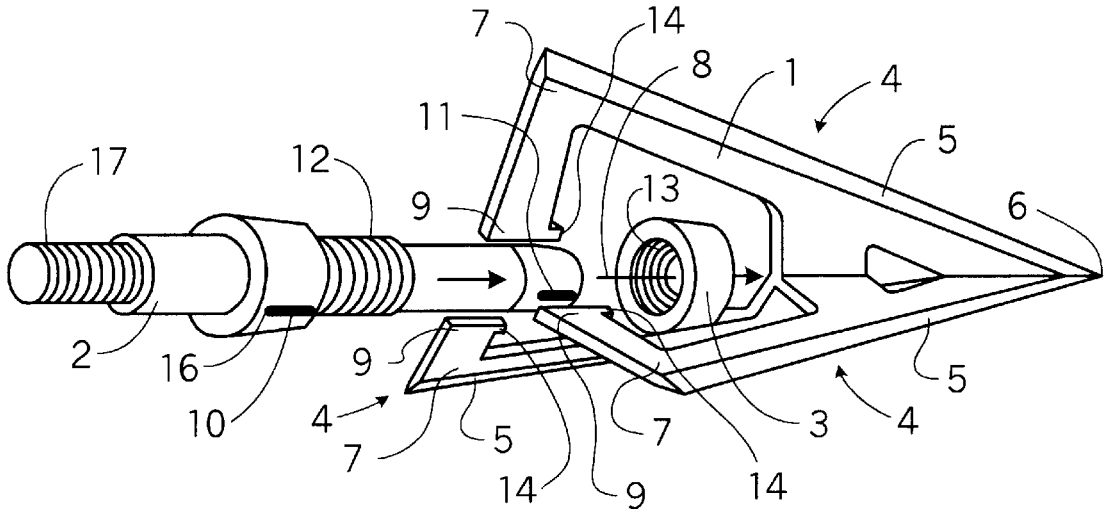
FIG. 1 is a perspective view of the modular broadhead of the present invention.
Figure 2:
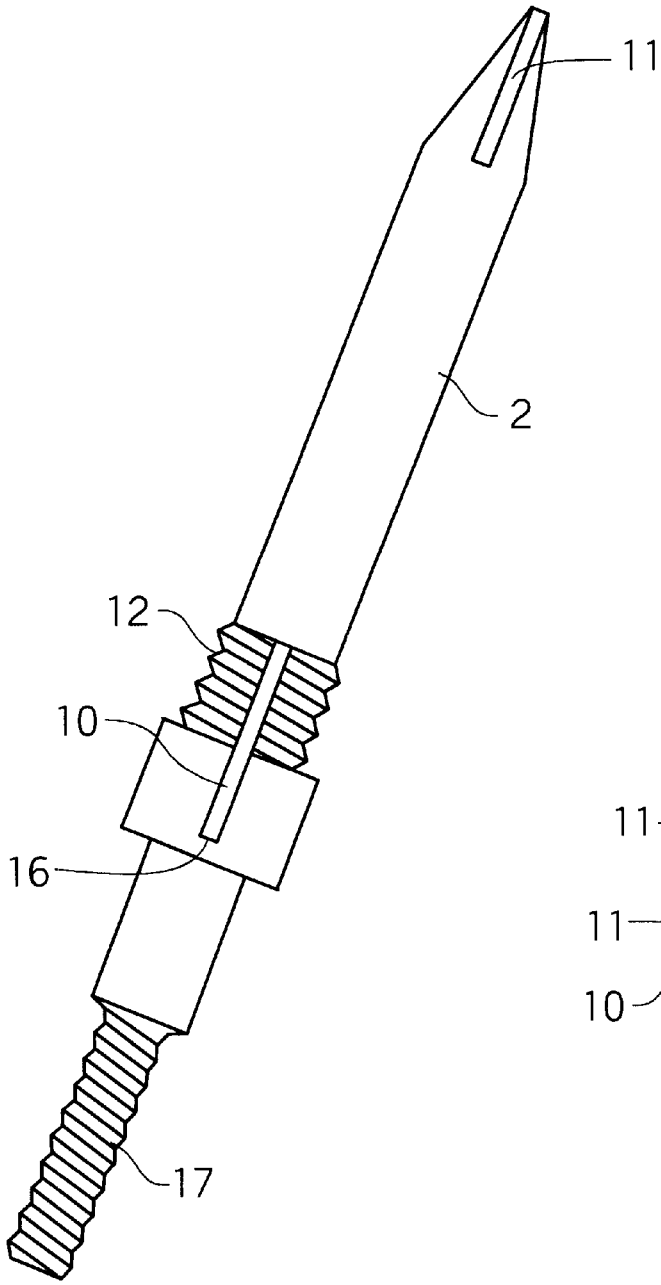
FIG. 2 is a view of the blade carrying body.
Figure 6:
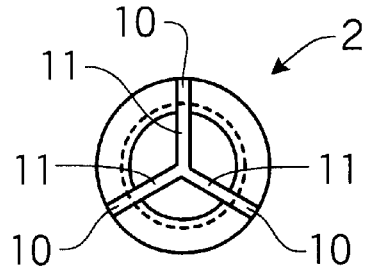
FIG. 6 is an end view of the blade carrying body as seen from the front.
Figure 3:
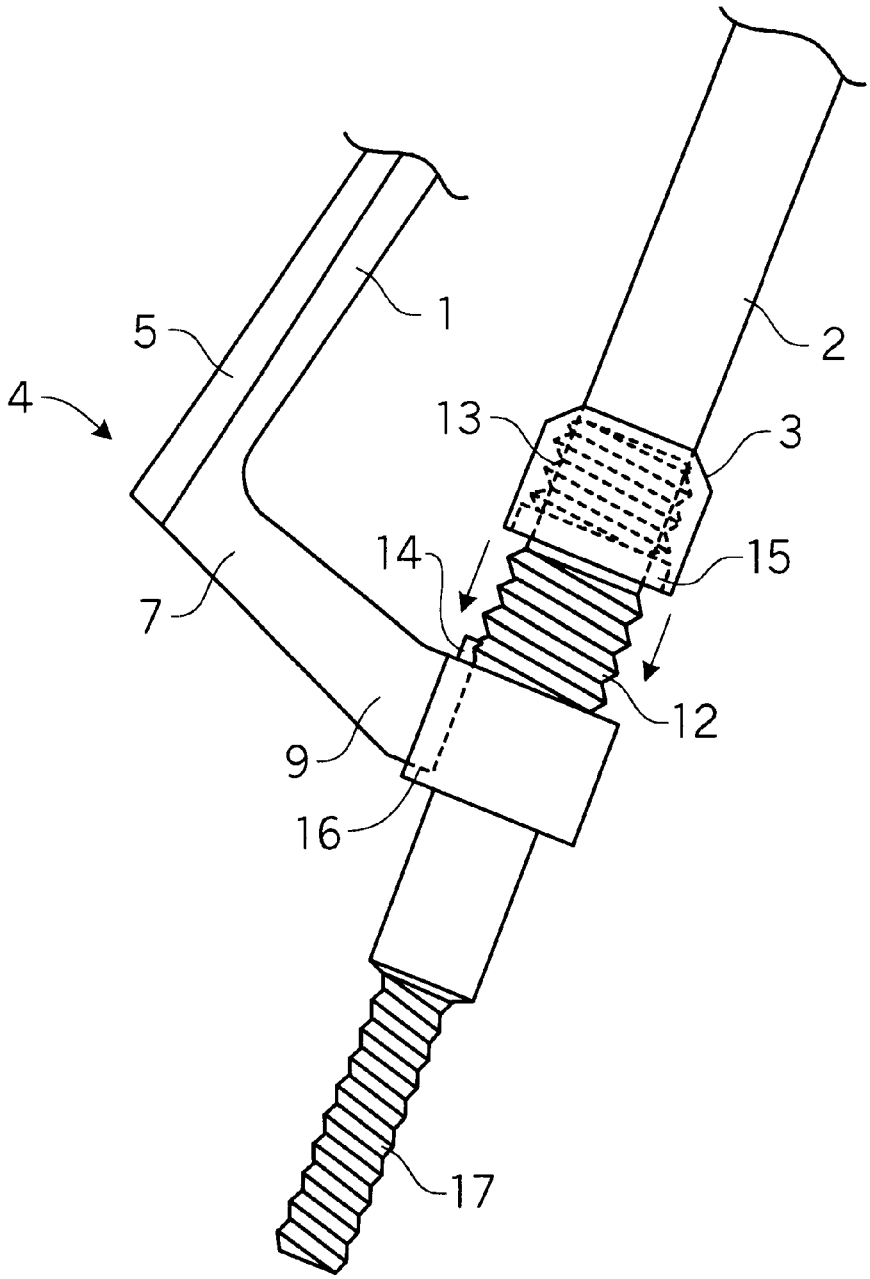
FIG. 3 is a partial cutaway view showing how the locking collar threads onto the blade carrying body and secures the unitary blade unit to the blade carrying body.

Referring now to the various drawings, and most particularly to FIG. 1, reference numeral 1 shows the unitary blade unit, the blade carrying body 2 and the locking collar 3 for securing the unitary blade unit 1 to the blade carrying body 2. The unitary blade unit 1 has multiple blades 4 each with razor edges 5 extending radially from the front 6 of the unitary blade unit 1 rearwardly to a base 7. The base 7 of each blade 4 extends inwardly toward the central axis 8 of the unitary blade unit 1 and forms a tab 9 capable of being slidably received in a rear slot 10 on the blade carrying body 2. The blade carrying body has multiple rear slots 10 to receive each tab 9. The blade carrying body 2 has multiple front slots 11 for slidably receiving each of the blades 4 toward the front of the unitary blade unit 1. The blade carrying body 2 has outer threads 12 forward of the rear slots 10. The locking collar 3 has inner threads 13 capable of mating with the outer threads 12 on the blade carrying body.

Preferably, each tab 9 has a nipple at the end extending toward the front of the unitary blade unit 1. The locking collar 3 preferably has an annular ring 15 capable of receiving each nipple 14 on each tab 9. Also preferably, each of the rear slots 10 has a rear shoulder stop 16 to prevent the unitary blade unit from sliding rearwardly of said shoulder stop 16.

Figure 4:
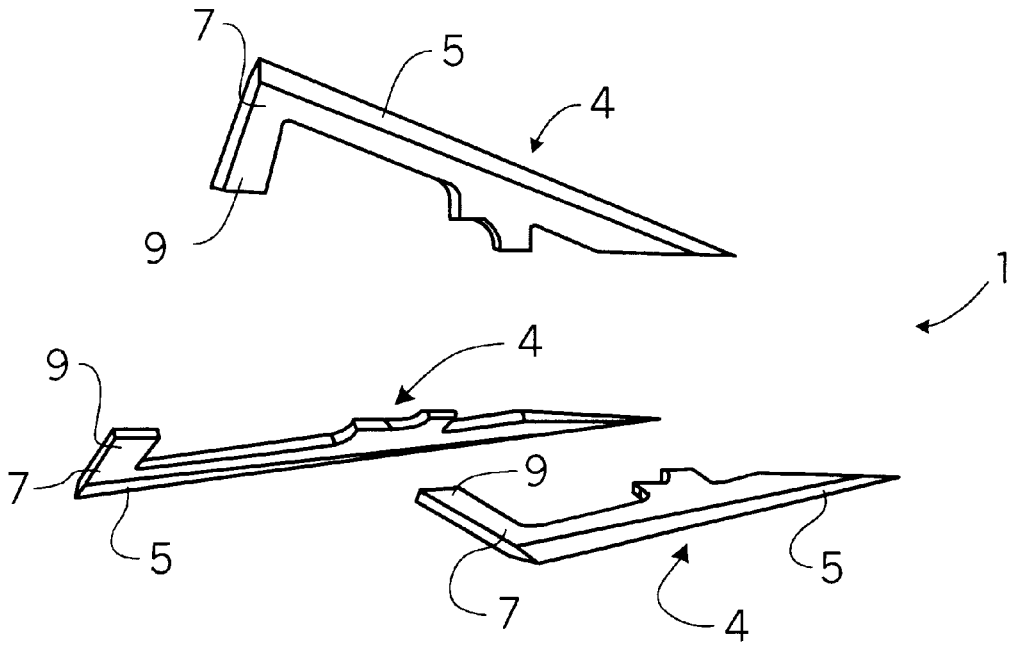
FIG. 4 is an exploded view of the unitary blade unit.

While it is to be understood that the unitary blade unit of the current invention requires multiple blades, i.e., two or more blades, it is preferred that the unitary blade unit has three blades 4 as shown in the various drawings. FIG. 4 shows an exploded view of the unitary blade unit having three blades 4. The unitary blade unit 1 of the present invention is unitary in that once it is made, it cannot be disassembled without destroying the unit. The unitary blade unit 1 may be made by welding, casting, brazing or by metal injection molding. The blade unit can also be made by any other means now known or later developed so long as the process produces a single piece having the structure disclosed herein.

The blade carrying body 2 is preferably a ferrule as shown in the various drawings. The ferrule has rear threads 17 to connect the ferrule to the shaft of an arrow (not shown) in a manner commonly used by many archers. Alternatively, the blade carrying body 2 can incorporate the arrow shaft as part of its construction.

The present invention is very easy to put together and to use. The blade carrying body 2 is inserted through the central axis 8 of the unitary blade unit 1 and through the locking collar 3, such that the tabs 9 slide into the rear slots 10 of the blade carrying body 2, and the front slots 11 on the blade carrying body slidably receive each of the blades 4 toward the front of the unitary blade unit 1. The inner threads 13 of the locking collar 3 are screwed onto the outer threads 12 of the blade carrying body 2. As the inner threads 13 on the locking collar 3 tighten onto the outer threads 12 of the blade carrying body 2, the locking collar 3 secures the unitary blade unit 1 to the blade carrying body 2. When the tabs 9 have the preferred nipple 14 and the locking collar 3 has the preferred annular ring 15, the nipple 14 is received by the annular ring 15 thereby providing additional securement of the blade carrying body 2 to the unitary blade unit 1. If the blade carrying body 2 is a ferrule, the ferrule can be screwed onto the arrow shaft and used by the archer. If the arrow shaft is incorporated into the blade carrying body, the system can be used as is by the archer.

Figure 5:
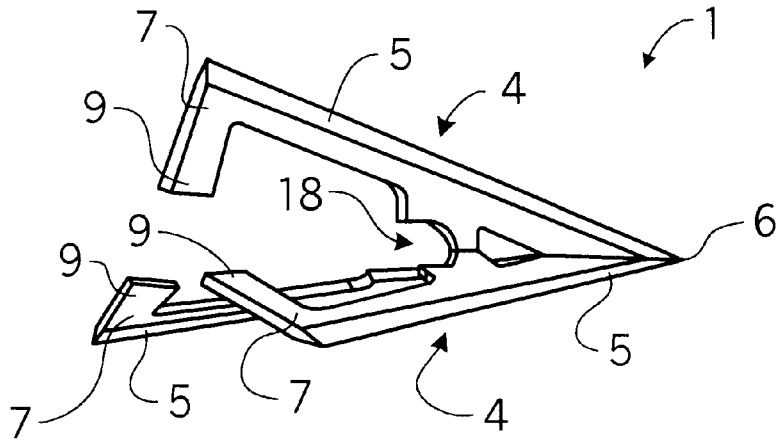
FIG. 5 is a view of the unitary blade unit.
Figure 7:
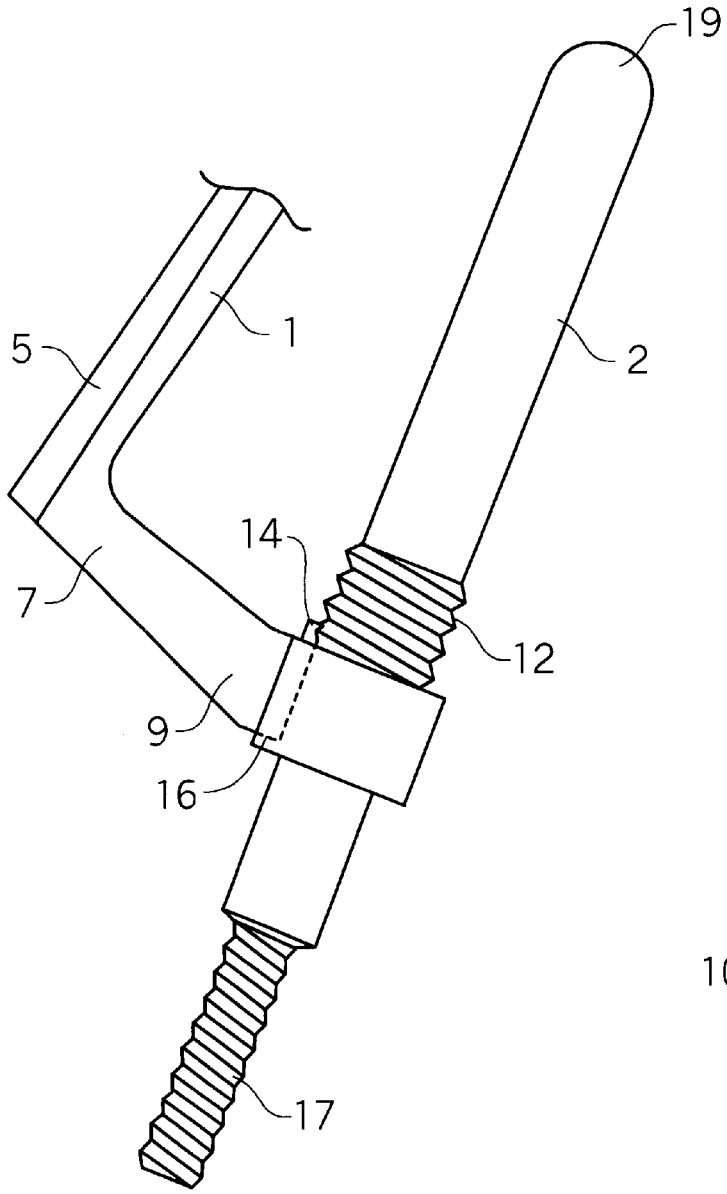
FIG. 7 is a partial cutaway view showing the front of the blade carrying body optionally having no slots. This structure can be used when the unitary blade unit has at least three blades to create an indent along the central axis capable of receiving the front of said blade carrying body.
Figure 8:
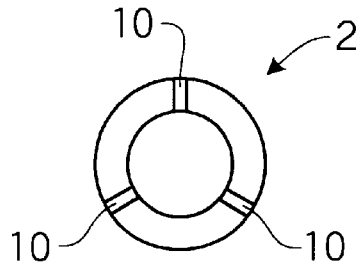
FIG. 8 is an end view of the blade carrying body, the front of which has no slots, as seen from the front, for optional use when the unitary blade unit has at least three blades.

When the unitary blade unit 1 has at least three blades 4, the present invention can optionally be modified to eliminate the front slots 11 on the blade carrying body 2. This can be done be having an indent 18 as shown in FIG. 5, the indent being created by the blades 4 at the central axis 8 toward the front of the unitary blade unit 1, the front 19 of the blade carrying body capable of being received within the indent 18. The three blades 4 hold the blade carrying body 2 in place without the need for the front slots 11, although the front slots 11 may optionally be used for further securement.

While these embodiments of the present invention have been shown and described, it will be obvious to those skilled in the art that changes and modifications will be made without departing from the invention in its broader aspects. The aim of the appended claims is to cover all such changes and modifications as fall within the true spirit and scope of the invention.

I claim:

1. A modular broadhead comprising a blade carrying body, a unitary blade unit with multiple blades each with razor edges extending radially from the front of the unitary blade unit rearwardly to a base, and a locking collar for securing the unitary blade unit to the blade carrying body, the base of each blade extending inwardly toward the central axis of the unitary blade unit and forming a tab capable of being slidably received in a rear slot on the blade carrying body, the blade carrying body having multiple rear slots to receive each tab, the blade carrying body having multiple front slots for slidably receiving each of the blades toward the front of the unitary blade unit, the blade carrying body having outer threads forward of the rear slots, and the locking collar having inner threads capable of mating with the outer threads on the blade carrying body.

2. The modular broadhead of claim 1 wherein each tab has a nipple at the end extending toward the front of the unitary blade unit and wherein the locking collar has an annular ring capable of receiving each nipple on each tab.

3. The modular broadhead of claim 1 wherein each of said multiple rear slots has a rear shoulder stop to prevent the unitary blade unit from sliding rearwardly of the stop.

4. The modular broadhead of claim 1 wherein the unitary blade unit has at least three blades.

5. A modular broadhead comprising a blade carrying body, a unitary blade unit with at least three blades each with razor edges extending radially from the front of the unitary blade unit rearwardly to a base, and a locking collar for securing the unitary blade unit to the blade carrying body, the base of each blade extending inwardly toward the central axis of the unitary blade unit and forming a tab capable of being slidably received in a rear slot on the blade carrying body, the blade carrying body having multiple rear slots to receive each tab, the front of the blade carrying body capable of being received within an indent created by the blades at the central axis toward the front of the unitary blade unit, the blade carrying body having outer threads forward of the rear slots, and the locking collar having inner threads capable of mating with the outer threads on the blade carrying body.

* * * * *